US008127890B2

(12) United States Patent
Meyers et al.

(10) Patent No.: US 8,127,890 B2
(45) Date of Patent: Mar. 6, 2012

(54) FLAT-FOLD STEP STOOL

(75) Inventors: Thomas J. Meyers, Greenwood, IN (US); Paul F. Meyers, Fishers, IN (US)

(73) Assignee: Cosco Management, Inc., Wilmington, DE (US)

( * ) Notice: Subject to any disclaimer, the term of this patent is extended or adjusted under 35 U.S.C. 154(b) by 767 days.

(21) Appl. No.: 12/060,526

(22) Filed: Apr. 1, 2008

(65) Prior Publication Data

US 2008/0251319 A1 Oct. 16, 2008

Related U.S. Application Data

(60) Provisional application No. 60/910,971, filed on Apr. 10, 2007.

(51) Int. Cl.
*E06C 7/14* (2006.01)

(52) U.S. Cl. ..... 182/21; 182/20; 182/25; 182/33; 182/156; 182/159; 182/161; 182/162; 182/165; 182/176

(58) Field of Classification Search ..... 182/156, 182/159, 161, 162, 165, 20, 21, 25, 176, 182/33
See application file for complete search history.

(56) References Cited

U.S. PATENT DOCUMENTS

| | | | | | |
|---|---|---|---|---|---|
| 276,339 | A * | 4/1883 | Beisner | 182/161 |
| 791,509 | A * | 6/1905 | Soergel | 182/165 |
| 806,915 | A * | 12/1905 | Reed | 182/22 |
| 958,732 | A * | 5/1910 | Dennis | 182/160 |
| 1,153,558 | A * | 9/1915 | Matheny | 182/29 |
| 1,198,739 | A * | 9/1916 | Marciniak et al. | 182/29 |
| 1,549,696 | A * | 8/1925 | Wernli et al. | 182/22 |
| 1,633,902 | A * | 6/1927 | Olson et al. | 182/161 |
| 2,006,674 | A * | 7/1935 | Diver | 403/106 |
| 2,172,860 | A * | 9/1939 | Weaver | 182/123 |
| 2,207,923 | A * | 7/1940 | Kelso | 182/156 |
| 2,230,015 | A * | 1/1941 | Rich | 182/161 |
| 2,245,825 | A * | 6/1941 | Ross | 52/10 |
| 2,952,301 | A * | 9/1960 | Schlaak et al. | 182/106 |
| 4,485,892 | A | 12/1984 | Maloney et al. | |
| 4,503,932 | A * | 3/1985 | Hilton | 182/113 |
| 5,722,507 | A * | 3/1998 | Kain | 182/129 |
| 5,762,163 | A * | 6/1998 | Kain | 182/161 |
| 6,000,497 | A | 12/1999 | Kain et al. | |
| 6,026,933 | A * | 2/2000 | King et al. | 182/165 |
| 6,347,687 | B1 * | 2/2002 | Alim | 182/161 |
| 6,443,261 | B1 | 9/2002 | Gibson et al. | |
| 6,450,290 | B1 * | 9/2002 | Spak | 182/165 |
| 6,536,557 | B2 | 3/2003 | Gibson et al. | |
| 6,550,579 | B2 | 4/2003 | Gibson et al. | |
| 6,902,035 | B2 | 6/2005 | Baumgartner et al. | |
| 7,104,361 | B2 * | 9/2006 | Walsh | 182/156 |
| 7,182,176 | B2 | 2/2007 | Gibson et al. | |
| 2007/0056797 | A1 * | 3/2007 | Wang | 182/21 |

* cited by examiner

*Primary Examiner* — Alvin Chin Shue
*Assistant Examiner* — Colleen M Quinn
(74) *Attorney, Agent, or Firm* — Barnes & Thornburg LLP

(57) ABSTRACT

A step unit includes right and left step frames and two steps coupled to the right and left step frames.

21 Claims, 8 Drawing Sheets

FLAT-FOLD STEP STOOL

This application claims priority under 35 U.S.C. §119(e) to U.S. Provisional Application Ser. No. 60/910,971, filed Apr. 10, 2007, which is expressly incorporated by reference herein.

BACKGROUND

The present disclosure relates to step stools and particularly to folding step stools. More particularly, the present disclosure relates to a multi-step folding step stool.

SUMMARY

A step stool in accordance with the present disclosure includes one or more steps coupled to right and left step frames. In illustrative embodiments, casters are coupled to the right and left step frames to create a rolling step stool.

In illustrative embodiments, a flat-fold step stool in accordance with the present disclosure is configured to be unfolded by a user once the step stool has been removed from a low-profile shipping container. The step stool can be unfolded to change from a knocked-down shipping mode to an erected use mode. Then, if desired, casters can be mounted on the underside of the right and left step frames. In illustrative embodiments, once the step stool is unfolded and changed to assume the erected use mode, it remains in that mode throughout its useful life.

In illustrative embodiments, the step unit includes a top step, a bottom step, and right and left step frames arranged to lie in spaced-apart relation to one another to locate the top and bottom steps therebetween. The right and left step frames are foldable and are mounted to each of the top and bottom steps for movement between a flat-fold shipping position and an unfolded use position. A right frame lock is configured to retain the right step frame in the unfolded use position. A left frame lock is provided to retain the left step frame in the unfolded use position.

Also in illustrative embodiments, each step frame includes a front riser and a step-support linkage. The front riser includes a front step mount that is pivotably coupled to the top and bottom steps. The step-support linkage includes a rear step mount pivotably coupled to the top and bottom steps, a rear riser pivotably coupled to the rear step mount, and a horizontal expander pivotably coupled to the rear step mount.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompany figures in which.

DETAILED DESCRIPTION

Figure 1:
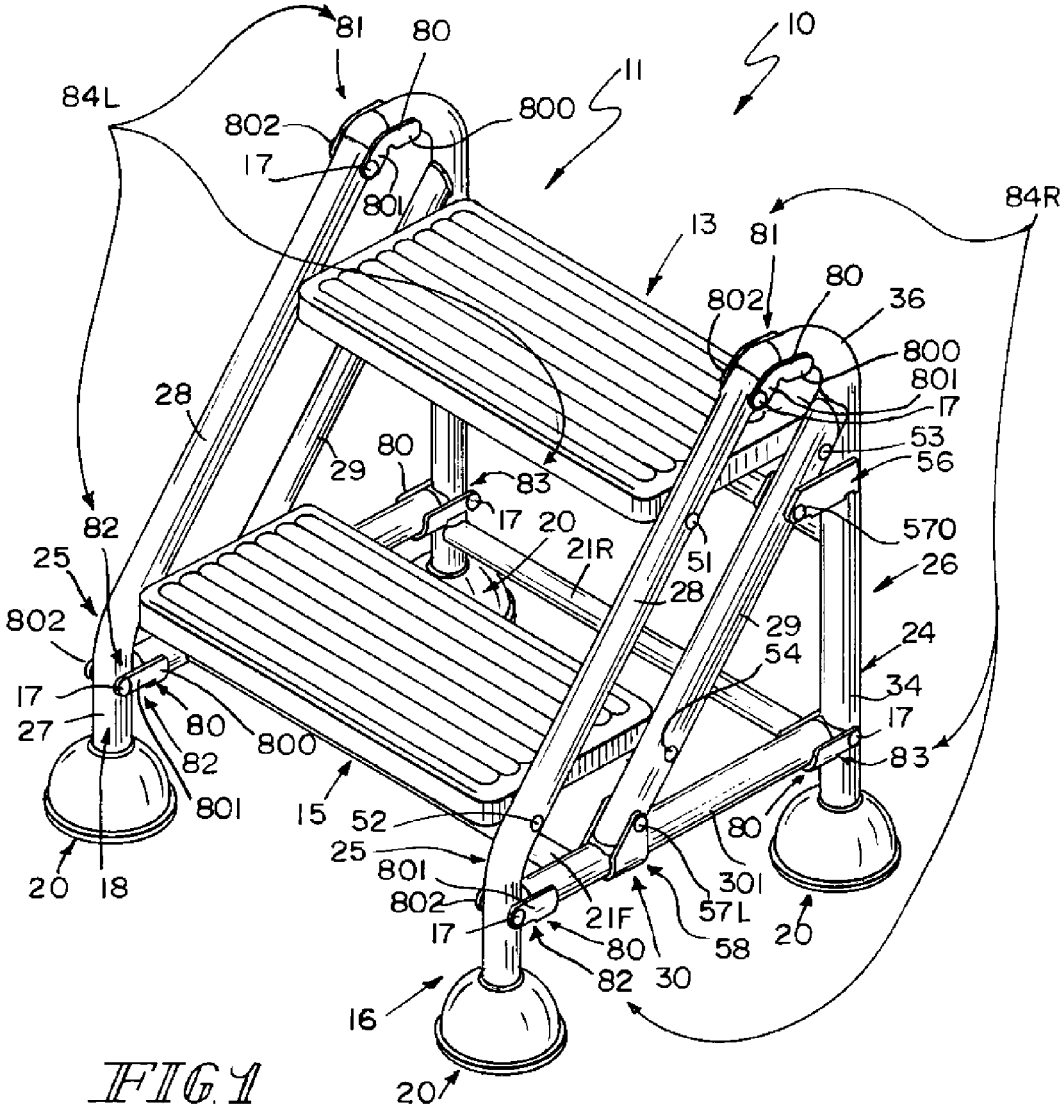
FIG. 1 is a perspective view of a step stool in accordance with a first embodiment of the present disclosure showing a step stool in an erected use mode.

A step stool 10 includes a foldable step unit 11 including a base 12 and top and bottom steps 13, 15 coupled to base 12 as shown in FIG. 1. In illustrative embodiments, step stool 10 further includes four caster units 20 coupled to a bottom portion of foldable step unit 11 for rolling movement relative to an underlying surface after foldable step unit 11 has been removed from a shipping carton and unfolded. Step stool 10 provides a step for a user for elevation when reaching for objects or any task where extra elevation would be desirable. An illustrative two-step step stool is shown in FIGS. 1-7 while a similar three-step step stool is shown in FIGS. 8-11.

Figure 3:
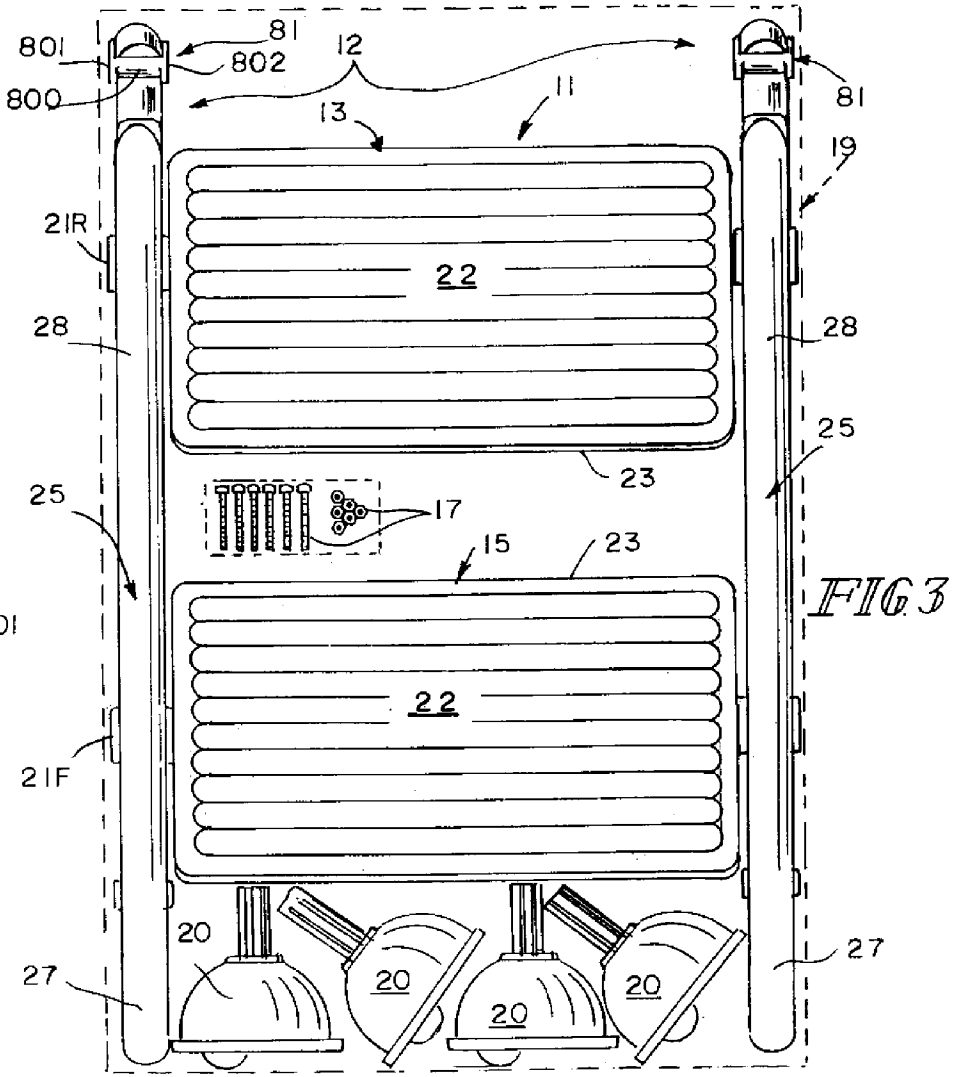
FIG. 3 is a front elevation view of the step stool of FIG. 2 showing the base, four caster units separated from the base, and fasteners used to fasten adjacent portions of the base after it has been removed from the shipping container and unfolded.
Figure 2:
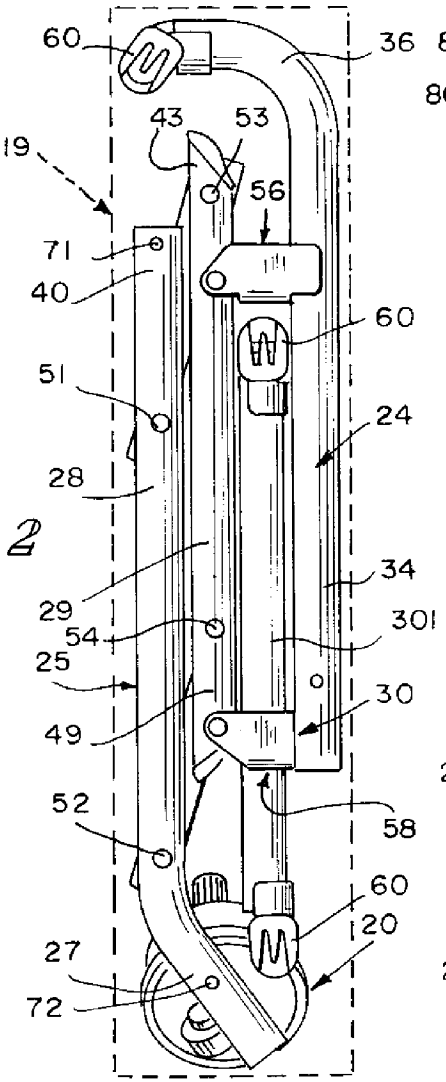
FIG. 2 is a side elevation view of the step stool of FIG. 1 in a knocked-down shipping mode stored in a shipping container (shown in phantom)

Step stool 10 is configured for transport as a kit in a knocked-down shipping mode as shown in FIGS. 2 and 3. In the knocked-down shipping mode, foldable step unit 11 is folded to assume a flat-fold configuration to fit easily into a low-profile shipping container 19, along with fasteners 17 and optional caster units 20.

Base 12 includes a foldable right step frame 16, a foldable left step frame 18, right and left frame locks 84R, 84L, a front stretcher 21F coupled to right and left step frames 16, 18, and a rear stretcher 21R coupled to right and left step frames 16, 18 as shown, for example, in FIG. 1. Right and left step frames 16, 18 are positioned to lie in a spaced-apart parallel relationship to one another as suggested in FIG. 1. Right and left step frames 16, 18 are similar to one another in structure and in function so that the description of right step frame 16 applies to left step frame 18 as well.

Figure 4:
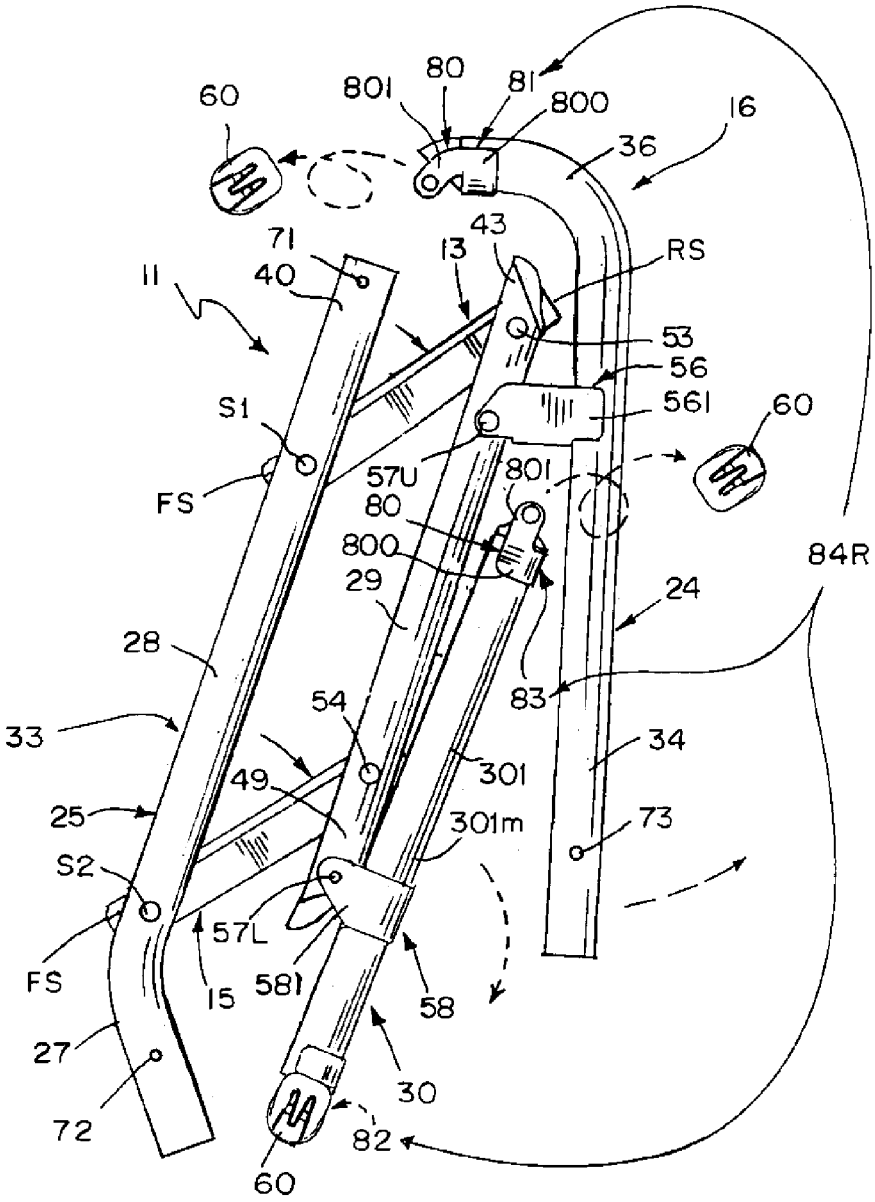
FIG. 4 is a side elevation view of the step stool shown in FIGS. 2 and 3 after it has been removed from the shipping container and partly unfolded and showing removal and discard of some of the packing plugs that are mounted on free ends of some of the tubular components included in the step stool to protect fastener brackets mounted on those free ends.

After a purchaser removes the folded step unit 11, fasteners 17, and caster units 20 from shipping container 19, step unit 11 is unfolded and readied as suggested in FIG. 4. Each of right and left frame locks 84R, 84L includes several connectors 81, 82, and 83 in an illustrative embodiment and is configured to define means for retaining the foldable right and left step frames 16, 18 in an unfolded use position as suggested in FIGS. 1 and 5 after the folded step unit 11 has been removed from shipping container 19 and unfolded. In illustrative embodiments, it is expected that step stool 10 will remain in its erected use mode during its useful life without ever returning to the knocked-down shipping mode.

Each top and bottom step 13, 15 includes a step platform 22 and a step rim 23 coupled to a perimeter edge of step platform 22 as shown in FIG. 1. Top and bottom steps 13, 15 are positioned to extend between right and left step frames 16, 18 as suggested in FIGS. 1 and 3.

Right step frame 16 includes a front riser 25 and a step-support linkage 26 comprising a rear riser 24, a rear step mount 29 coupled for pivotable movement about an upper pivot axis 57U to an upper portion of rear riser 24, and a horizontal expander 30 coupled for pivotable movement about a lower pivot axis 57L to a lower portion 49 of rear step mount 29 as shown best, for example, in FIG. 4. Right step frame 16 is shown in a flat-fold shipping position in FIG. 2 and a partly unfolded position in FIG. 4 and a fully unfolded use position in FIG. 5.

Figure 5:
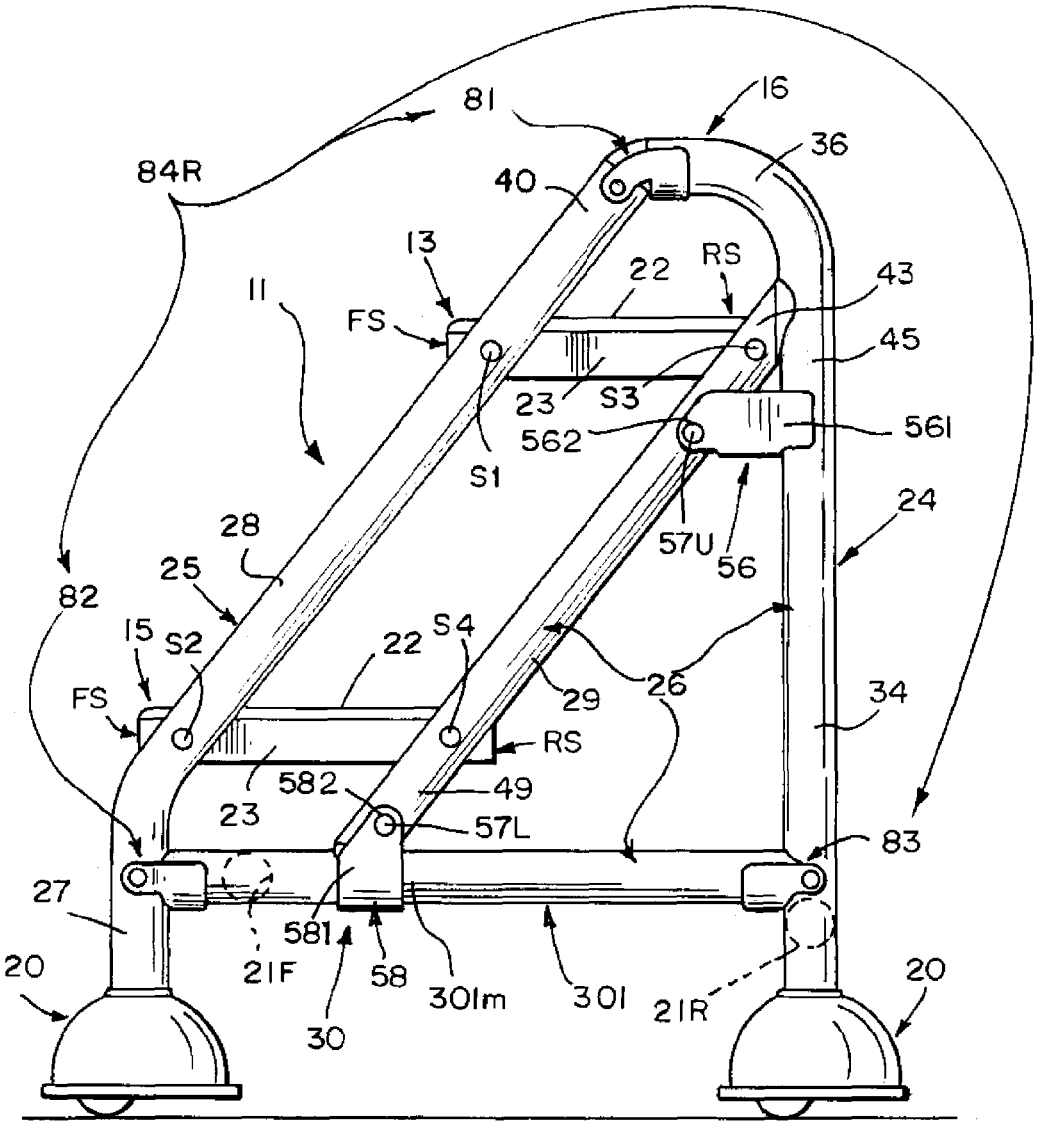
FIG. 5 is a side elevation view of the step stool of FIG. 1 showing the right step frame including a front riser and a step-support linkage including a rear step mount coupled to a rear riser on an upper end, top and bottom steps coupled to the rear step mount, a horizontal expander coupled to a lower end of the rear step mount, and front and rear casters.

In illustrative embodiments, rear riser 24 includes a vertical leg 34 and a bent leg 36 coupled to an upper end 45 of vertical leg 34 as suggested in FIG. 5. Bent leg 36 has a curved shape in the illustrated embodiment. Front riser 25 includes a front step mount 28 and a bent front leg 27 coupled to a lower portion of front step mount 28 as also suggested in FIG. 4.

Top and bottom steps 13, 15 are mounted on front riser 25 and step-support linkage 26 for movement relative to both front and rear step mounts 28, 29 when right and left step frames 16, 18 of base 12 of step stool 10 are unfolded as suggested in FIG. 4 to move between a flat-fold shipping position shown in FIGS. 2 and 3 and an expanded use position shown in FIGS. 1 and 5. Front step mount 28 of front riser 25 is pivotably coupled to a front section FS of top step 13 at a first pivot axis S1 and to a front section FS of bottom step 15 at a second pivot axis S2. Rear step mount 29 of step-support linkage 26 is pivotably coupled to a rear section RS of top step 13 at a third (top) pivot axis S3 and to a rear section RS of bottom step 15 at a fourth (bottom) pivot axis S4 as shown in FIG. 4. As suggested in FIGS. 4 and 5, a collapsible parallelogram unit 33 is defined by front and rear step mounts 28, 29 and top and bottom steps 13, 15 and pivot pins establishing pivot axes S1, S2, S3, and S4.

Connectors 81, 82, and 83 are included in right step frame 16 of step stool 10 and cooperate to define a right frame lock 84R. Similarly, connectors 81, 82, and 83 are included in left step frame 18 and cooperate to define a left frame lock 84L. Connectors 81, 82, and 83 are configured to join components included in step stool 10 to one another to retain step unit 11 in the erected use mode as shown, for example, in FIGS. 1 and 5 after it has been removed from shipping container 19 and unfolded. In illustrative embodiments, each of connectors 81, 82, 83 includes a fastener bracket 80 and a companion fastener 17 as suggested in FIGS. 1 and 5.

As suggested in FIG. 1, each fastener bracket 80 includes a half-round tube mount 800 and a pair of spaced-apart tabs 801, 802 cantilevered to half-round tube mount 800. Half-round tube mount 800 is coupled to either bent leg 36 of rear riser 24 or the opposite ends of horizontal leg 301 of horizontal expander 30 and companion tabs 801, 802 are separated to define a space receiving a neighboring portion of either front riser 25 or rear riser 24 therein. Such neighboring portion is formed to include a fastener receiver 71, 72, or 73 sized to receive one of fasteners 17 therein as suggested in FIG. 4. In an illustrative embodiment, each fastener 17 comprises a pin and a nut configured to be coupled to the pin as suggested in FIG. 3.

As suggested in FIGS. 1 and 5, front and rear step mounts 28, 29 are positioned to lie in spaced-apart parallel relation to one another such that upper ends 40, 43 of front and rear step mounts 28, 29 are coupled to rear riser 24, lower end 49 of rear step mount 29 is coupled to horizontal expander 30, and front leg 27 is coupled to horizontal expander 30 when step unit 11 is configured to assume the erected use mode. In particular, an upper end 40 of front step mount 28 is coupled to a free end 42 of bent leg 36 by means of connector 81 and an upper end 43 of rear step mount 29 is mated with an upper end 45 of vertical leg 34 as shown in FIGS. 1 and 5. Horizontal expander 30 is arranged to extend between a lower portion of rear riser 24 and front leg 27 of front riser 25. A front end of horizontal expander 30 is coupled to front leg 27 of front riser 25 by means of connector 82 and a rear end of horizontal expander 30 is coupled to vertical leg 34 of rear riser 24 by means of connector 83. Each of front and rear step mounts 28, 29 are inclined to extend at acute angles relative to a companion vertical leg 34 when right and left step frames 16, 18 are unfolded to move from the flat-fold shipping position shown in FIGS. 2 and 3 to the expanded use position shown in FIGS. 1 and 5.

Rear riser 24 of each of foldable right and left step frames 16, 18 further includes first hinge unit 56 anchored to vertical leg 34 and configured to include upper hinge means for supporting upper end 43 of rear step mount 29 for pivotable movement about an upper pivot axis 57U during folding movement of right and left step frames 16, 18 of base 12 between the flat-fold shipping position shown in FIGS. 2 and 3 and the expanded use position shown in FIG. 5. In an illustrative embodiment, first hinge unit 56 includes a pivot arm 561 cantilevered to upper end 45 of vertical leg 34 and a pivot pin 562 coupled to a free end of pivot arm 561 and to upper end 43 of rear step mount 29 to establish upper pivot axis 57U. Illustratively, pivot arm 561 comprises two thin plates arranged to lie in spaced-apart relation to one another to locate portions of vertical leg 34, rear step mount 29, and pivot pin 562 therebetween as shown in FIG. 1.

Horizontal expander 30 of each of foldable right and left step frames 16, 18 includes a horizontal leg 301 and a second hinge unit 58 anchored to horizontal leg 301. Second hinge unit 58 is configured to include lower hinge means for supporting lower end 49 of rear step mount 29 for pivotable movement about a lower pivot axis 57L during folding movement of right and left step frames 16, 18 of base 12 between the collapsed shipping position shown in FIGS. 2 and 3 and the expanded use position shown in FIG. 5. In an illustrative embodiment, second hinge unit 58 includes a pivot arm 581 cantilevered to a middle portion 301*m* of horizontal leg 301 and a pivot pin 582 coupled to a free end of pivot arm 581 and to lower end 49 of rear step mount 29 to establish lower pivot axis 57L. Illustratively, pivot arm 581 comprises two thin plates arranged to lie in spaced-apart relation to one another to locate portions of horizontal leg 301, rear step mount 29, and pivot pin 582 therebetween as shown in FIG. 1.

In the knocked-down shipping mode shown in FIGS. 2 and 3, front step mount 28 of front riser 25, rear step mount 29, horizontal expander 30, and vertical leg 34 of rear riser 24 are positioned to lie in parallel side-by-side relation to one another. Step unit 11 and, in particular, foldable right and left step frames 16, 18, are unfolded after the step unit 11 has been removed from shipping container 19.

Step unit 11 is unfolded and erected as suggested in FIGS. 4 and 5 once it is removed from shipping container 19. In the flat-fold shipping position shown in FIG. 2, a packing plug 60 is mounted temporarily on each of fastener brackets 80 to provide a protective covering. Once step unit 11 is removed from shipping container 19, packing plugs 60 in place on right and left step frames 16, 18 can be removed and discarded as suggested in FIG. 4.

During unfolding, step-support linkage 26 is unfolded to withdraw horizontal expander 30 from a stored location positioned to lie between rear step mount 29 and vertical leg as suggested in FIG. 4 and to cause horizontal expander 30 to move to engage lower ends of each of rear and front risers 24, 25 as suggested in FIG. 5. Simultaneously, the collapsible parallelogram 33 comprising top and bottom steps 13, 15 and front and rear step mounts 28, 29 expands as suggested in FIGS. 4 and 5 owing to increased separation between front and rear step mounts 28, 29. Once erected, as shown in FIGS. 1 and 5, connectors 81, 82, 83 in each of right and left step frames 16, 18 retain the frame components in the expanded use position to provide a rigidified step unit 11.

In illustrative embodiments, step unit 11 includes a top step 13, a bottom step 15, and right and left step frames 16, 18 arranged to lie in spaced-apart relation to one another to locate top and bottom steps 13, 15 therebetween and mounted to each of top and bottom steps 13, 15 for movement between a flat-fold shipping position shown in FIGS. 2 and 3 and an unfolded use position shown in FIGS. 1 and 5. Right step frame 16 includes a front riser 25 pivotably coupled to each of top and bottom steps 13, 15 and a step-support linkage 16 including a rear step mount 29 pivotably coupled to each of top and bottom steps 13, 15, a rear riser 24 pivotably coupled to rear step mount 29, and a horizontal expander 39 pivotably coupled to rear step mount 29. Right frame lock 84R is configured to retain night step frame 16 in the unfolded use position. Right frame lock 84R includes a first connector 81 configured to couple rear riser 24 to front riser 25, a second connector 82 configured to couple a front end of horizontal expander 30 to front riser 25, and a third connector 83 configured to couple an opposite rear end of horizontal expander 30 to rear riser 24.

Front riser 25 includes a front step mount 28 and a front leg 27 coupled to front step mount 28. Front step mount 28 is pivotably coupled to a front section of top step 13 at a first pivot axis S1 and to a front section of bottom step 15 at a second pivot axis S2. Rear step mount 29 is pivotably coupled to a rear section of top step 13 at a third pivot axis S3 and to a rear section of bottom step 15 at a fourth pivot axis S4. Front step mount 28, top step 13, rear step mount 29, and bottom step 15 are arranged in series cooperatively to form a collapsible parallelogram unit 33 that expands during movement of right step frame 16 to assume the unfolded use position as suggested in FIGS. 4 and 5.

Horizontal expander 30 includes a horizontal leg 301 arranged to extend between front and rear risers 25, 24 upon movement of right step frame 16 to assume the unfolded use position as suggested in FIGS. 1 and 5. Rear step mount 29 is positioned to lie between front step mount 28 and horizontal leg 301 of horizontal expander 30 upon movement of right step frame 116 to assume the flat-fold shipping position as shown in FIG. 2. Horizontal expander 30 further includes a hinge unit 58 mounted on horizontal leg 301 to move therewith and pivotably couple to rear step mount 29. Rear riser 24 includes a vertical leg 34 and horizontal leg 301 of horizontal expander 30 is positioned to lie between rear step mount 29 and vertical leg 34 of rear riser 24 upon movement of right step frame 16 to assume the flat-fold shipping position as shown in FIG. 2.

Rear riser 24 includes a vertical leg 34 and a bent leg 36 coupled to vertical leg 34 and arranged to mate with front step mount 28 of front riser 24 upon movement of right step frame 16 to assume the unfolded use position as suggested in FIG. 5. Bent legs 27, 36 of front and rear risers 25, 24 lie in spaced-apart relation to one another to define a space therebetween receiving rear step mount 29 and horizontal leg 301 of horizontal expander 30 of the step-support linkage 16 therein upon movement of right step frame 16 to assume the flat-fold shipping position as shown in FIG. 2. Front step mount 28, rear step mount 29, and vertical leg 34 lie in parallel relation to one another upon movement of right step frame 16 to assume the flat-fold shipping position as shown in FIG. 2.

Horizontal expander 30 includes a horizontal leg 301 arranged to extend between front and rear risers 25, 24 upon movement of right step frame 16 to assume the unfolded use position and a hinge unit 58 mounted on horizontal leg 301 to move therewith and pivotably coupled to rear step mount 29 at a lower pivot axis 57L. First connector 81 includes a first fastener bracket 80 coupled to rear riser 24. Second connector 82 includes a second fastener bracket 80 coupled to a front end of horizontal leg 301. Third connector 83 includes a third fastener bracket 80 coupled to a rear end of horizontal leg 301. First connector 81 further includes a first fastener 17 coupled to front riser 25 and to first fastener bracket 80 to anchor front riser 25 to rear riser 24 upon movement of right-step frame 16 to assume the expanded use position. Second connector 82 further includes a second fastener 17 coupled to front riser 25 and to second fastener bracket 80 to anchor front riser 25 to horizontal expander 30 upon movement of right-step frame 16 to assume the expanded use position. Third connector 83 further includes a third fastener 17 coupled to third fastener bracket 80 and to rear riser 24 to anchor rear riser 24 to horizontal expander 30 upon movement of right step frame 16 to assume the expanded use position. A removable packing plug 60 is mounted temporarily on each of the first, second, and third fastener brackets 80 while right step frame 16 remains in the flat-fold shipping position as suggested in FIG. 2.

Rear riser 24 includes a vertical leg 34 and a hinge unit 56 mounted on vertical leg 34 to move therewith and pivotably coupled to rear step mount 29 at an upper pivot axis 57U. Bottom step 15 is pivotably coupled to rear step mount 29 at a bottom pivot axis S4 located between the upper and lower pivot axes 57U, 57L. Top step 13 is pivotably coupled to rear step mount 29 at a top pivot axis S3 arranged to lie in spaced-apart location to bottom pivot axis 34 to locate upper pivot axis 57U therebetween. Vertical leg 34 of rear riser 24 and horizontal leg 34 of horizontal expander 30 cooperate to lie in side-by-side parallel relation to one another upon movement of right step frame 16 to assume the flat-fold storage position as shown in FIG. 2. Vertical leg 34 of rear riser 24 and horizontal leg 301 of horizontal expander 30 cooperate to lie in perpendicular relation to one another upon movement of right step frame 16 to assume the expanded use position as shown in FIG. 5. Front riser 25 includes a front step mount 28 pivotably coupled to top and bottom steps 13, 15 and arranged to remain in parallel relation to rear step mount 29 during movement of right step frame 16 between the flat-fold shipping position and the expanded use position.

Figure 6:
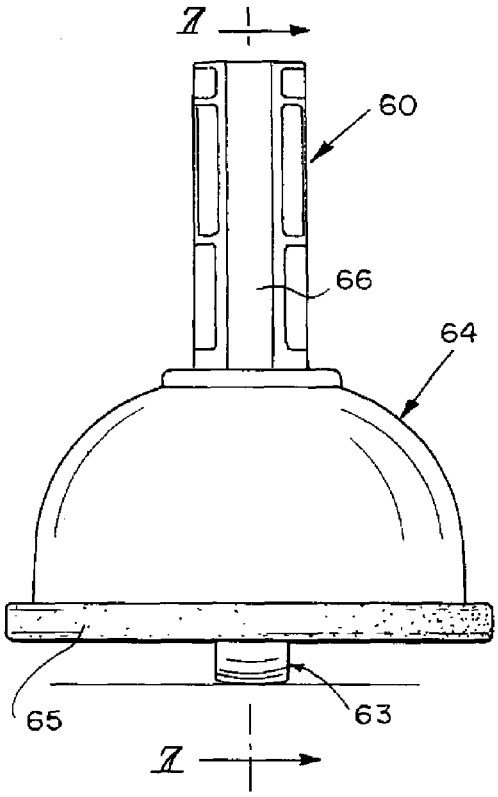
FIG. 6 is a front elevation view of a caster unit of FIG. 5 showing (from top to bottom) a mount, a housing coupled to the mount, and a retractable caster.
Figure 7:
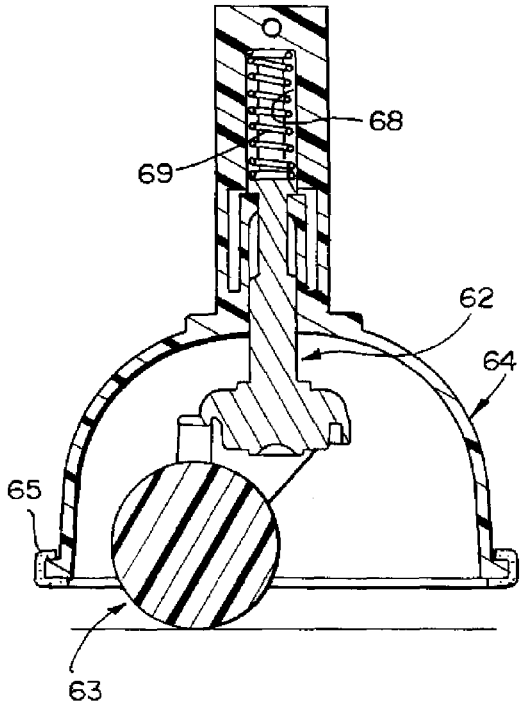
FIG. 7 is a side sectional view taken along line 7-7 of FIG. 6 showing (from top to bottom) the mount, a retractor, and the retractable caster coupled to the retractor.

Caster unit 20 includes a mount 60, a retractor assembly 62 coupled to the mount, and a caster 63 as shown in FIGS. 6 and 7. In illustrative embodiments, caster unit 20 further includes a housing 64 and a high-friction bumper 65 coupled to housing 64. Upon expansion of base 12 from the shipping mode to the use mode, a caster unit 20 is coupled to each lower end 44 of vertical rear 24 and to each leg portion 50 of first step supports 26 to provide rolling means for rolling step stool 10.

Mount 60 includes an outer portion 66 and is formed to include a hollow 68 to receive a portion of retractor assembly therein as shown in FIG. 7. Mount 60 is received by a hollow interior portion of both lower end 44 and leg portion 50.

As the user places weight on step stool 10, retractor assembly 62 moves in an upwardly direction relative to mounts 60 which acts to collapse housing 64 thereby lowering bumper 65 into frictional engagement with the underlying surface thus inhibiting movement of base 12 relative to the underlying surface. As the user removes weight from step stool 10, a biasing member 69 causes retractor assembly 62 to move downwardly relative to mounts 60 causing bumper 65 to move upwardly. As bumper 65 disengages from the underlying surface, casters 63 are once again roll freely.

Figure 8:
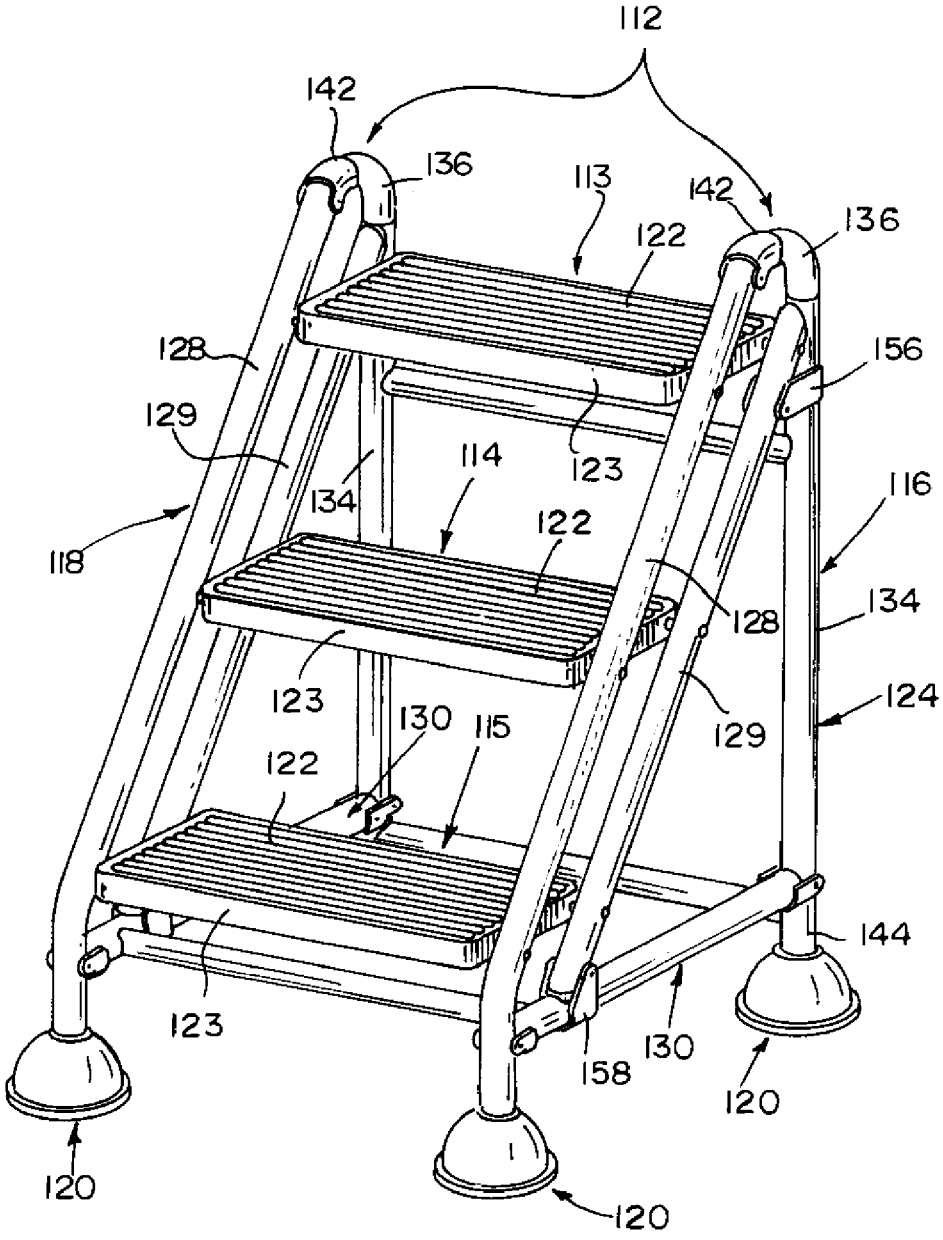
FIG. 8 is a view similar to FIG. 1 showing a second illustrative embodiment of the step stool having a top, a middle, and a bottom step.

In a second illustrative embodiment, a step stool 110 includes a base 112, a top step 113, a middle step 114, and a bottom step 115 as shown in FIG. 8. In illustrative embodiments, step stool 110 further includes four caster units 120 coupled to a bottom end of base 112 for rolling movement relative to an underlying surface. Step stool 110 provides a step for a user for elevation when reaching for objects or any task where extra elevation would be desirable.

Figure 10:
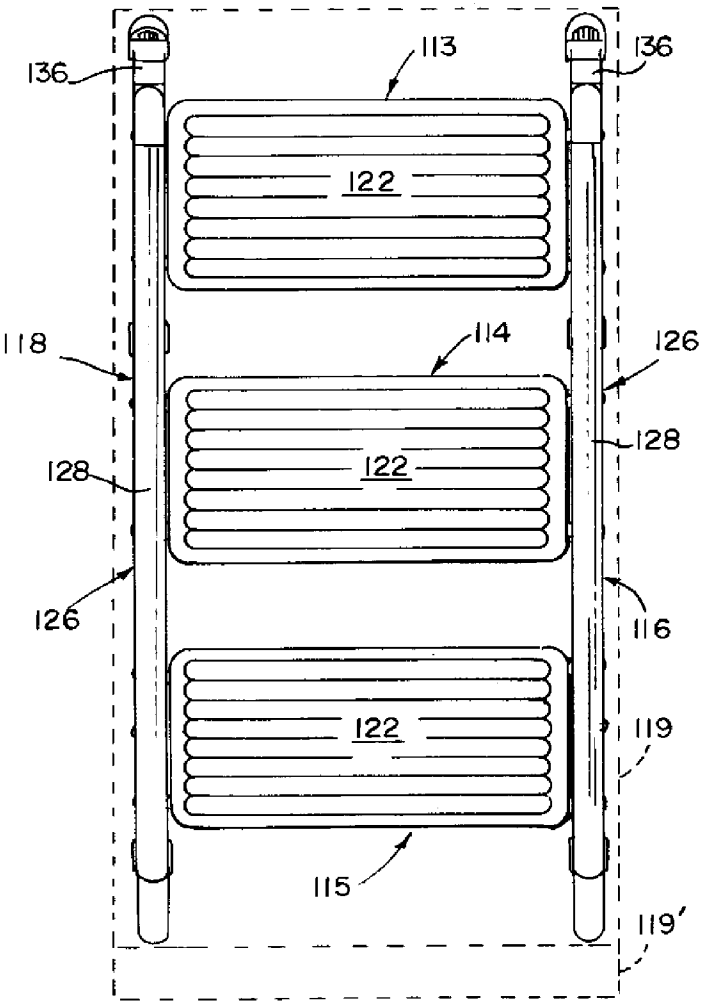
FIG. 10 is a view similar to FIG. 3 of the three-step step stool.
Figure 9:
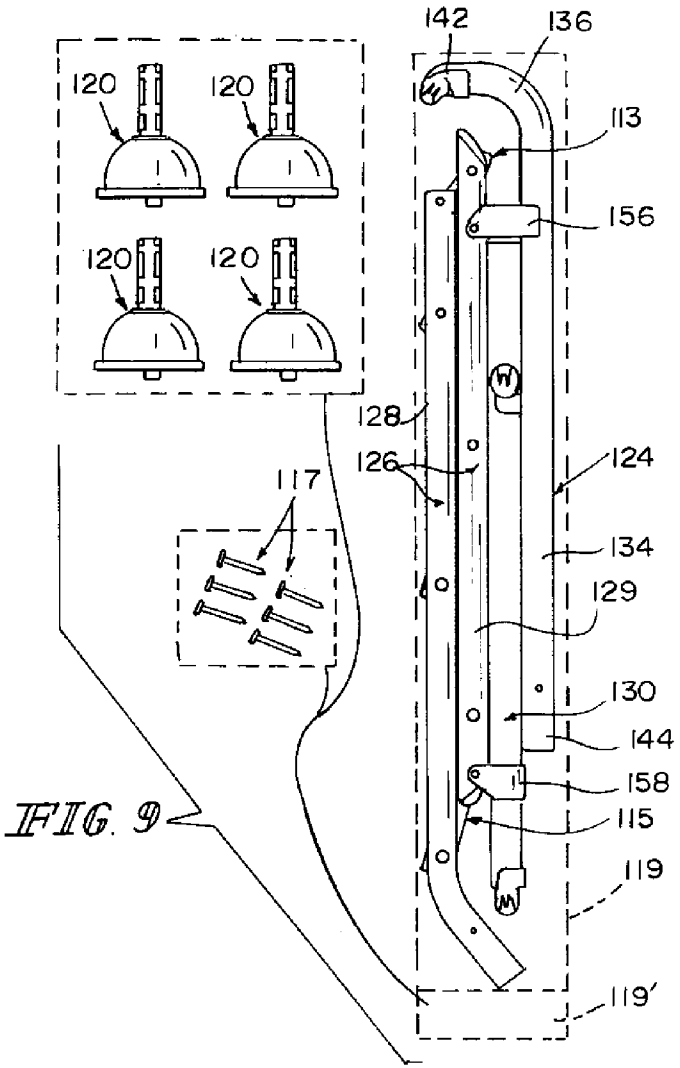
FIG. 9 is a view similar to FIG. 2 showing the three-step step stool kit.

Step stool 110 is configured for transport as a kit in a knocked-down, flat-fold shipping mode as shown in FIGS. 9 and 10. In the shipping mode, components of base 112 are positioned to lie in a side-by-side relationship to one another to reduce the profile of step stool 110 and sized to be received, for example, in a shipping container 119. An accessory container 119 is configured to store accessory items for assembly such as, for example, caster units 120 and fasteners 117, within shipping container 119.

A user assembles step stool 110 for expansion upon first use from the shipping mode suggested in FIGS. 9 and 10 to a use mode shown in FIG. 8. In the assembly, elements of base 112 are expanded, coupled together another using fasteners 117, and finally, caster units 120 are mounted to base 112.

Base 112 includes a right step frame 116 and a left step frame 118 as shown, for example, in FIG. 8. Right and left step frames 116, 118 are positioned to lie in a spaced-apart relationship to one another. Right and left step frames 116, 118 are similar to one another in structure and in function so that the description of right step frame 116 applies to left step frame 118 as well.

Each top, middle, and bottom step 113, 114, and 115 includes a step platform 122 and a step rim 123 coupled to a perimeter edge of step platform 122 as shown in FIG. 8. Top, middle, and bottom steps 113, 114, and 115 are positioned to extend between right and left step frames 116, 118.

Figure 11:
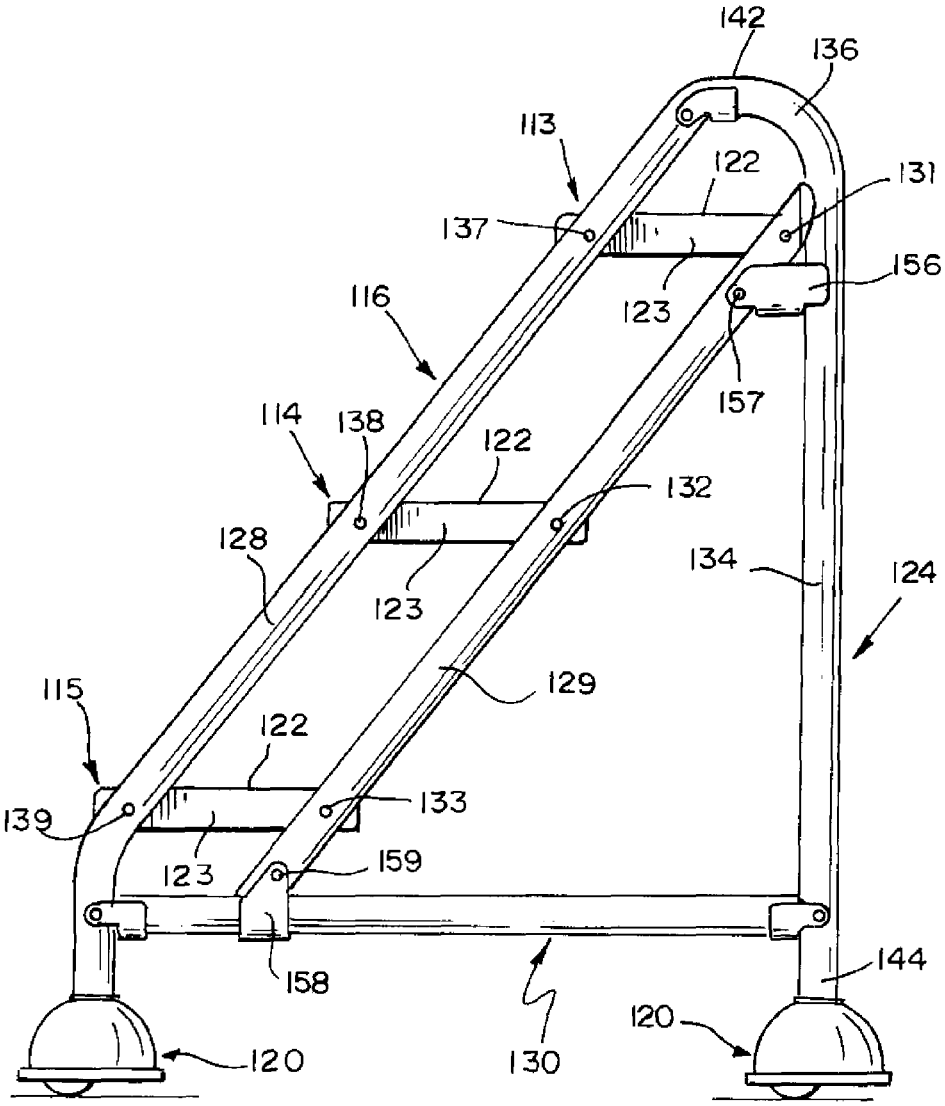
FIG. 11 is a view similar to FIG. 5 showing the three-step step stool.

Right step frame 116 includes a front riser 125 and a step-support linkage 126 comprising a rear step coupled to an upper portion of rear riser 124, and a horizontal expander 130 as shown best, for example, in FIG. 11. In illustrative embodiments, rear riser 124 includes a vertical leg 134 and a bend 136 coupled to an upper end 145 of vertical leg 134 as suggested in FIG. 11. Bend 136 has a curved shape in the illustrated embodiment.

Top, middle, and bottom steps 13, 14, and 15 are mounted on step mounts 128, 129 for movement relative to both step mounts 28, 29 when right and left step frames 116, 118 of base 112 of step stool 10 are unfolded to move between a collapsed shipping position shown in FIGS. 9 and 10 and an expanded use position shown in FIGS. 8 and 11. Font step mount 128 is pivotably coupled to a front section FS of each of top, middle, and bottom steps 113, 114, and 115. Rear step mount 129 is pivotably coupled to a rear section RS of each of top, middle, and bottom steps 13, 14, and 15 as shown in FIG. 11. Top, middle, and bottom steps 113, 114, and 115 are positioned to lie in spaced-apart parallel relation to one another such that upper ends 140, 143 of front and rear step mounts 128, 129 are coupled to vertical riser 124 and lower end 147, 149 of front and rear step mounts 128, 129 is coupled to horizontal expander 130. In particular, an upper end 140 of front step mount 128 is coupled to a free end 142 of bend 136 and an upper end 143 of rear step mount 129 is coupled to an upper end 145 of vertical leg 134 as shown in FIGS. 8 and 11. Each of front and rear step mounts 128, 129 are inclined to extend at acute angles relative to a companion vertical leg 134 when right and left step frames 116, 118 are unfolded to move from the collapsed shipping position shown in FIGS. 9 and 10 to the expanded use position shown in FIGS. 8 and 11.

Rear riser 124 of each of right and left step frames 116, 118 further includes first hinge unit 156 anchored to vertical leg 134 and configured to include upper hinge means for supporting upper end 143 of rear step mount 129 for pivotable movement about an upper pivot axis 1570 during movement of right and left step frames 116, 118 of base 112 between the collapsed shipping position shown in FIGS. 9 and 10 and the expanded use position shown in FIG. 11. In an illustrative embodiment, first hinge unit 156 includes a pivot arm 1561 cantilevered to upper end 145 of vertical leg 134 and a pivot pin 1562 coupled to a free end of pivot arm 1561 and to upper end 143 of rear step mount 129 to establish upper pivot axis 157U. Illustratively, pivot arm 1561 comprises two thin plates arranged to lie in spaced-apart relation to one another to locate portions of vertical leg 134, rear step mount 129, and pivot pin 1562 therebetween as shown in FIG. 8.

Horizontal expander 130 of each of right and left step frames 116, 118 includes a horizontal leg 1301 and a second hinge unit 158 anchored to horizontal leg 1301. Second hinge unit 158 is configured to include lower hinge means for supporting lower end 149 of rear step mount 129 for pivotable movement about a lower pivot axis 157L during movement of right and left step frames 116, 118 of base 112 between the collapsed shipping position shown in FIGS. 9 and 10 and the expanded use position shown in FIG. 11. In an illustrative embodiment, second hinge unit 158 includes a pivot arm 1581 cantilevered to a middle portion 1301*m* of horizontal leg 1301 and a pivot pin 1582 coupled to a free end of pivot arm 1581 and to lower end 149 of rear step mount 129 to establish lower pivot axis 157L. Illustratively, pivot arm 1581 comprises two thin plates arranged to lie in spaced-apart relation to one another to locate portions of horizontal leg 1301, rear step mount 129, and pivot pin 1582 therebetween as shown in FIG. 8.

In the shipping mode shown in FIGS. 9 and 10, front step mount 128 of front riser 125, rear step mount 129, horizontal expander 130, and vertical leg 134 of rear riser 124 are positioned to lie in a parallel side-by-side relationships to one another.

The pivoting movement of rear riser 124 from the shipping mode of FIGS. 9 and 10 to the use mode of FIG. 8 causes an upper end of step support 126 to confront an upper end of vertical leg 134 which in turn causes a clockwise movement of top, middle, and bottom steps 113, 114, and 115 about pivot axes 131, 132, and 133, respectively. The upward movement of step support 126 causes the front portion of top, middle and bottom steps 113, 114, and 115 to pivot upwardly about pivot axes 137, 139, and 138, respectively, to assume a horizontal orientation as suggested in FIG. 1. Horizontal expander is arranged to be coupled to front riser 125 on one end and to be coupled to rear riser 124 on another end.

Caster units 120 and caster units 20 are similar to one another in structure and in function. The description of caster units 20 applies to caster units 120 as well.

The invention claimed is:

1. A step unit comprising a top step, a bottom step, right and left step frames arranged to lie in spaced-apart relation to one another to locate the top and bottom steps therebetween and mounted to each of the top and bottom steps for movement between a flat-fold shipping position and an unfolded use position, the right step frame includes a front riser pivotably coupled to each of the top and bottom steps and a step-support linkage including a rear step mount pivotably coupled to each of the top and bottom steps, a rear riser pivotably coupled to the rear step mount, and a horizontal expander pivotably coupled to the rear step mount, wherein the horizontal expander includes a horizontal leg that is pivotably coupled to the front riser, matingly connected to the rear riser, and pivotably coupled to the rear step mount and is arranged to extend between the front and rear risers upon movement of the right step frame to assume the unfolded use position and the rear step mount is positioned to lie between the front step mount and the horizontal leg of the horizontal expander upon movement of the right step frame to assume the flat-fold shipping position, and wherein the horizontal expander further includes a hinge unit mounted on the horizontal leg to move therewith and is pivotably coupled directly to the rear step mount.

2. The step unit of claim 1, wherein the front riser includes a front step mount and a front leg coupled to the front step mount, the front step mount is pivotably coupled to a front section of the top step at a first pivot axis and to a front section of the bottom step at a second pivot axis, the rear step mount of step-support linkage is pivotably coupled to a rear section of the top step at a third pivot axis and to a rear section of the bottom step at a fourth pivot axis, and the front step mount, top step, rear step mount, and bottom step are arranged in series cooperatively to form a collapsible parallelogram unit that expands during movement of the right step frames to assume the unfolded use position.

3. The step unit of claim 1, wherein the rear riser includes a vertical leg and the horizontal leg of the horizontal expander is positioned to lie between the rear step mount and the vertical leg of the rear riser upon movement of the right step frame to assume the flat-fold shipping position.

4. The step unit of claim 1, wherein the rear riser includes a vertical leg and a bent leg coupled to the vertical leg and arranged to mate with the front step mount of the front riser upon movement of the right step frame to assume the unfolded use position and the front and rear risers lie in spaced-apart relation to one another to define a space therebetween receiving the rear step mount and the horizontal expander of the step-support linkage therein upon movement of the right step frame to assume the flat-fold shipping position.

5. The step unit of claim 4, wherein the front step mount, rear step mount, and vertical leg lie in parallel relation to one another upon movement of the right step frame to assume the flat-fold shipping position.

6. The step unit of claim 1, further comprising a right frame lock configured to retain the right step frame in the unfolded use position, the right frame lock including a first connector configured to couple the rear riser to the front riser, a second connector configured to couple a front end of the horizontal expander to the front riser, and a third connector configured to couple an opposite rear end of the horizontal expander to the rear riser.

7. A step unit comprising a top step, a bottom step, right and left step frames arranged to lie in spaced-apart relation to one another to locate the top and bottom steps therebetween and mounted to each of the top and bottom steps for movement between a flat-fold shipping position and an unfolded use position, the right step frame includes a front riser pivotably coupled to each of the top and bottom steps and a step-support linkage including a rear step mount pivotably coupled to each of the top and bottom steps, a rear riser pivotably coupled to the rear step mount, and a horizontal expander pivotably coupled to the rear step mount, a right frame lock configured to retain the right step frame in the unfolded use position, the right frame lock including a first connector configured to couple the rear riser to the front riser, a second connector configured to couple a front end of the horizontal expander to the front riser, and a third connector configured to couple an opposite rear end of the horizontal expander to the rear riser, and wherein the horizontal expander includes a horizontal leg that is pivotably coupled to the front riser, matingly connected to the rear riser, and pivotably coupled to the rear step mount and is arranged to extend between the front and rear risers upon movement of the right step frame to assume the unfolded use position and a first hinge unit mounted on the horizontal leg to move therewith and pivotably coupled to the rear step mount at a lower pivot axis located below the top step.

8. The step unit of claim 7, wherein the first connector includes a first fastener bracket coupled to the rear riser, the second connector includes a second fastener bracket coupled to a front end of the horizontal leg, and the third connector includes a third fastener bracket coupled to a rear end of the horizontal leg.

9. The step unit of claim 8, wherein the first connector further includes a first fastener coupled to the front riser and to the first fastener bracket to anchor the front riser to the rear riser upon movement of the right-step frame to assume the expanded use position, the second connector further includes a second fastener coupled to the front riser and to the second fastener bracket to anchor the front riser to the horizontal expander upon movement of the right-step frame to assume the expanded use position, and the third connector further includes a third fastener coupled to the third fastener bracket and to the rear riser to anchor the rear riser to the horizontal expander upon movement of the right step frame to assume the expanded use position.

10. The step unit of claim 8, further comprising a removable packing plug mounted temporarily on each of the first, second, and third fastener brackets while the right step frame remains in the flat-fold shipping position.

11. The step unit of claim 7, wherein the rear riser includes a vertical leg and a second hinge unit mounted on the vertical leg to move therewith and pivotably coupled to the rear step mount at an upper pivot axis, the bottom step is pivotably coupled to the rear step mount at a bottom pivot axis located between the upper and lower pivot axes, and the top step is pivotably coupled to the rear step mount at a top pivot axis arranged to lie in spaced-apart location to the bottom pivot axis to locate the upper pivot axis therebetween.

12. The step unit of claim 11, wherein the vertical leg of the rear riser and the horizontal leg of the horizontal expander cooperate to lie in side-by-side parallel relation to one another upon movement of the right step frame to assume the flat-fold storage position.

13. The step unit of claim 11, wherein the vertical leg of the rear riser and the horizontal leg of the horizontal expander cooperate to lie in perpendicular relation to one another upon movement of the right step frame to assume the expanded use position.

14. The step unit of claim 13, wherein the front riser includes a front step mount pivotably coupled to the top and bottom steps and arranged to remain in parallel relation to the rear step mount during movement of the right step frame between the flat-fold shipping position and the expanded use position.

15. A step unit comprising a top step, a bottom step, right and left step frames arranged to lie in spaced-apart relation to one another to locate the top and bottom steps therebetween, the right step frame includes a front riser including a front step mount and a front leg coupled to the front step mount, a rear riser including a vertical leg, a first hinge unit coupled to the vertical leg, and a bent leg coupled to the vertical leg, a horizontal expander including a horizontal leg and a second hinge unit coupled to the horizontal leg, and a rear step mount, wherein the front step mount is pivotably coupled to each of the top and bottom steps, the rear step mount is pivotably coupled to each of the top and bottom steps and arranged to lie in parallel relation to the front step mount, the horizontal leg is coupled to the front leg of the front riser and the vertical leg of the rear riser, the second hinge unit is pivotably coupled to the rear step mount, the first hinge unit is pivotably coupled to the rear step mount, the vertical leg of the rear riser is mated with the rear step mount, and the bent leg is coupled to the front step mount.

16. The step unit of claim 15, wherein the rear step mount and portions of the horizontal and vertical legs cooperate to define a triangle-shaped portion of the right step frame.

17. A step unit comprising a top step, a bottom step, right and left step frames arranged to lie in spaced-apart relation to one another to locate the top and bottom steps therebetween and mounted to each of the top and bottom steps for movement between a flat-fold shipping position and an unfolded use position, the right step frame includes a front riser pivotably coupled to each of the top and bottom steps and a step-support linkage including a rear step mount pivotably coupled to each of the top and bottom steps, a rear riser pivotably coupled to the rear step mount, and a horizontal expander pivotably coupled to the rear step mount, and wherein the rear riser includes a vertical leg and a first hinge unit coupled to the vertical leg and pivotably coupled to the rear step mount, the horizontal expander includes a horizontal leg and a second hinge unit coupled to the horizontal leg and pivotably coupled to the rear step mount, the front riser includes a front step mount pivotably coupled to the top and bottom steps, and wherein, in the flat-fold shipping position, the front step mount, the rear step mount, the horizontal leg, and the vertical leg are arranged to lie in parallel relation to one another to cause the rear step mount to lie in a space between the front step mount and the horizontal leg and to cause the horizontal leg to lie in another space between the rear step mount and the vertical leg, and wherein the front riser further includes a front leg coupled to the front step mount, the rear riser further includes a bent leg coupled to the vertical leg and wherein, in the expanded use position, the bent leg is coupled to the front step mount, a front end of the horizontal leg is coupled to the front leg, a rear end of the horizontal leg is coupled to the rear leg, and a portion of the rear step mount is arranged to mate with the vertical leg.

18. The step unit of claim 17, wherein the front and rear step mounts are arranged to lie in parallel relation to one another upon movement of the right step frame to assume the expanded use position.

19. A step unit comprising a top step, a bottom step, right and left step frames arranged to lie in spaced-apart relation to one another to locate the top and bottom steps therebetween and mounted to each of the top and bottom steps for movement between a flat-fold shipping position and an unfolded use position, the right step frame includes a front riser pivotably coupled to each of the top and bottom steps and a step-support linkage including a rear step mount pivotably coupled to each of the top and bottom steps, a rear riser pivotably coupled to the rear step mount, and a horizontal expander pivotably coupled to the rear step mount, a right frame lock configured to retain the right step frame in the unfolded use position, the right frame lock including a first connector configured to couple the rear riser to the front riser, a second connector configured to couple a front end of the horizontal expander to the front riser, and a third connector configured to couple an opposite rear end of the horizontal expander to the rear riser, wherein the horizontal expander includes a horizontal leg arranged to extend between the front and rear risers upon movement of the right step frame to assume the unfolded use position and a first hinge unit mounted on the horizontal leg to move therewith and is pivotably coupled directly to the rear step mount at a pivot axis, wherein the first connector includes a first fastener bracket coupled to the rear riser, the second connector includes a second fastener bracket coupled to a front end of the horizontal leg, and the third connector includes a third fastener bracket coupled to a rear end of the horizontal leg, and wherein the first connector further includes a first fastener coupled to the front riser and to the first fastener bracket to anchor the front riser to the rear riser upon movement of the right-step frame to assume the expanded use position, the second connector further includes a second fastener coupled to the front riser and to the second fastener bracket to anchor the front riser to the horizontal expander upon movement of the right-step frame to assume the expanded use position, and the third connector further includes a third fastener coupled to the third fastener bracket and to the rear riser to anchor the rear riser to the horizontal expander upon movement of the right step frame to assume the expanded use position.

20. A step unit comprising a top step, a bottom step, right and left step frames arranged to lie in spaced-apart relation to one another to locate the top and bottom steps therebetween and mounted to each of the top and bottom steps for movement between a flat-fold shipping position and an unfolded use position, the right step frame includes a front riser pivotably coupled to each of the top and bottom steps and a step-support linkage including a rear step mount pivotably coupled to each of the top and bottom steps, a rear riser pivotably coupled to the rear step mount, and a horizontal expander pivotably coupled to the rear step mount, a right frame lock configured to retain the right step frame in the unfolded use position, the right frame lock including a first connector configured to couple the rear riser to the front riser, a second connector configured to couple a front end of the horizontal expander to the front riser, and a third connector configured to couple an opposite rear end of the horizontal expander to the rear riser, wherein the horizontal expander includes a horizontal leg arranged to extend between the front and rear risers upon movement of the right step frame to assume the unfolded use position and a first hinge unit mounted on the horizontal leg to move therewith and pivotably coupled to the rear step mount at a pivot axis located below the top step, wherein the first connector includes a first fastener bracket coupled to the rear riser, the second connector includes a second fastener bracket coupled to a front end of the horizontal leg, and the third connector includes a third fastener bracket coupled to a rear end of the horizontal leg, and further comprising a removable packing plug mounted temporarily on each of the first, second, and third fastener brackets while the right step frame remains in the flat-fold shipping position.

21. A step unit comprising a top step, a bottom step, right and left step frames arranged to lie in spaced-apart relation to one another to locate the top and bottom steps therebetween and mounted to each of the top and bottom steps for movement between a flat-fold shipping position and an unfolded use position, the right step frame includes a front riser pivotably coupled to each of the top and bottom steps and a step-support linkage including a rear step mount pivotably coupled to each of the top and bottom steps, a rear riser pivotably coupled to the rear step mount, and a horizontal expander pivotably coupled to the rear step mount, a right frame lock configured to retain the right step frame in the unfolded use position, the right frame lock including a first connector configured to couple the rear riser to the front riser, a second connector configured to couple a front end of the horizontal expander to the front riser, and a third connector configured to couple an opposite rear end of the horizontal expander to the rear riser, wherein the horizontal expander includes a horizontal leg arranged to extend between the front and rear risers upon movement of the right step frame to assume the unfolded use position and a first hinge unit mounted on the horizontal leg to move therewith and pivotably coupled to the rear step mount at a lower pivot axis, and wherein the rear riser includes a vertical leg and a second hinge unit mounted on the vertical leg to move therewith and pivotably coupled to the rear step mount at an upper pivot axis, the bottom step is pivotably coupled to the rear step mount at a bottom pivot axis located between the upper and lower pivot axes, and the top step is pivotably coupled to the rear step mount at a top pivot axis arranged to lie in spaced-apart location to the bottom pivot axis to locate the upper pivot axis therebetween.

* * * * *